US012559876B2

(12) United States Patent
Sieding et al.

(10) Patent No.: US 12,559,876 B2
(45) Date of Patent: Feb. 24, 2026

(54) DRUM FOR A WASHING MACHINE AND WASHING MACHINE

(71) Applicant: Miele & Cie. KG, Guetersloh (DE)

(72) Inventors: Dirk Sieding, Luenen (DE); Marcel Zielke, Ennigerloh (DE); Steffen Lasner, Borgholzhausen (DE); Benedikt Fechtel, Rheda-Wiedenbrueck (DE); Alfons Eblenkamp, Rietberg (DE)

(73) Assignee: MIELE & CIE. KG, Guetersloh (DE)

( * ) Notice: Subject to any disclaimer, the term of this patent is extended or adjusted under 35 U.S.C. 154(b) by 108 days.

(21) Appl. No.: 18/577,844

(22) PCT Filed: Jun. 28, 2022

(86) PCT No.: PCT/EP2022/067710
§ 371 (c)(1),
(2) Date: Jan. 9, 2024

(87) PCT Pub. No.: WO2023/280634
PCT Pub. Date: Jan. 12, 2023

(65) Prior Publication Data

US 2024/0328057 A1 Oct. 3, 2024

(30) Foreign Application Priority Data

Jul. 9, 2021 (BE) ..... 2021/5535

(51) Int. Cl.

| | |
|---|---|
| ***D06F 37/06*** | (2006.01) |
| *D06F 34/08* | (2020.01) |
| *D06F 37/30* | (2020.01) |
| *D06F 39/08* | (2006.01) |

(52) U.S. Cl.
CPC ..... *D06F 37/065* (2013.01); *D06F 34/08* (2020.02); *D06F 37/30* (2013.01); *D06F 39/083* (2013.01); *D06F 39/088* (2013.01)

(58) Field of Classification Search
CPC ..... D06F 37/065
See application file for complete search history.

(56) References Cited

FOREIGN PATENT DOCUMENTS

| | | | | |
|---|---|---|---|---|
| CN | 201169699 | Y | 12/2008 | |
| CN | 108315954 | A | 7/2018 | |
| DE | 29705226 | U1 | 7/1998 | |
| EP | 1433888 | B1 | 6/2004 | |
| EP | 2309048 | A1 | 4/2011 | |
| EP | 2628839 | A1 * | 8/2013 | ..... D06F 37/065 |
| WO | 2009103683 | A1 | 8/2009 | |
| WO | 2021197899 | A1 | 10/2021 | |

OTHER PUBLICATIONS

International Search Report dated Sep. 8, 2022.

* cited by examiner

*Primary Examiner* — Jason Y Ko
(74) *Attorney, Agent, or Firm* — Dickinson Wright PLLC

(57) ABSTRACT

A drum for a washing machine has a suds container, in which the drum can be rotatably mounted about a horizontal or inclined axis, including a cylindrical shell that is delimited by means of two opposite end walls, at least one driver element that is attached to the inner surface of the shell. A driver element for the drum is designed as a curved body having a curvature directed toward the drum interior and is arranged at a distance from the end walls.

16 Claims, 4 Drawing Sheets

DRUM FOR A WASHING MACHINE AND WASHING MACHINE

RELATED APPLICATIONS

The present disclosure claims priority to and the benefit of PCT Application PCT/EP2022/067710, filed on Jun. 28, 2022, which claims priority to and the benefit of Belgium Application BE2021/5535, filed on Jul. 9, 2021, the entire contents of both of which are incorporated herein by reference.

TECHNICAL FIELD

The disclosure relates to a drum for a washing machine having a suds container in which the drum can be rotatably mounted about a horizontal or inclined axis, comprising a cylindrical shell that is delimited by means of two opposite end walls, at least one driver element that is attached to the inner surface of the shell.

BACKGROUND

To wash laundry in a drum-type washing machine, the laundry is washed with water with the addition of detergent with a strong drum movement. In this case, the drum is perforated so that the water in the suds container comes into contact with the laundry located in the drum. In order to improve the wetting, scoop ribs are attached in the drum, which scoop ribs lift the water upward from the lower region of the suds container and distribute it over the laundry from there.

A drum of this type for a washing machine is known from EP 1 433 888 B1. The drum comprises lifting ribs that are distributed over the circumference on the inner side of the drum shell. In this case, the laundry items are only lifted in the circumferential direction until they are detached from the drum shell, resulting in a so-called laundry fall. The lifting ribs comprise concave indentations on the side surfaces, which indentations serve as water storage units for lifting the washing liquid. Due to the concave shape of the side surface regions, it can happen that laundry items do not detach from the rib and then remain adhered to the inner surface of the drum shell. Furthermore, the concave curvature at the free end of the lifting rib forms an angular, uneven transition that can greatly deform or chafe the laundry items in contact therewith.

A drum having a corresponding lifting rib is also known from EP 2 309 048 A1.

SUMMARY

The disclosure provides a drum in which the laundry items are gently and particularly effectively mixed with the washing liquid.

The fundamental advantage of the drum according to the disclosure is that an improved movement of the laundry items inside the drum is achieved when they are arranged approximately horizontally or inclined and are rotated at a rotational speed customary for the washing phase, for example 20 to 70 rpm. Furthermore, the protection of the laundry items is maintained such that premature wear or damage is prevented.

For this purpose, the drum according to the disclosure comprises driver elements or at least one driver element that is designed as a curved body having a curvature directed toward the drum interior and is arranged at a distance from the end walls. The driver elements are designed such that they do not extend from the front end wall to the rear end wall, but represent a separate elevation that is surrounded at the base by the shell surface.

This shape ensures that the laundry items are subjected to a force impulse during the washing movement in order lift them up, wherein it is also ensured that the element slides off safely without the laundry items rubbing strongly against an edge of the free end. The driver element projects only slightly from the shell into the drum interior, so that laundry items that strike the element are only slightly deformed. Overall, protection is improved for a given washing mechanism. A further advantage is that the elements each have a small volume compared to the conventional drum rib so that the greatest possible drum volume is achieved for a given drum dimension.

In a preferred embodiment, the driver element is designed as a truncated pyramid having a circular or polygonal base surface, wherein the diameter of the base surface has a value that corresponds to approximately ⅙ to ⅓ of the distance between the two end walls of the drum. The end walls delimit the depth of the drum.

In an another overall advantageous embodiment, the base surface of the truncated cone or truncated pyramid is designed as a circle, an at least virtually equilateral triangle, a square, a pentagon, a heptagon, an octagon, particularly preferably as a hexagon. These polygons are inherently stable and have finite surfaces that face in different directions when viewed around the circumference of the base surface.

In an overall practical embodiment, the apex of the truncated pyramid is flat or curved (convex) and the outline corresponds to the shape of the outline of the base surface. As a result, the side surfaces that connect the base surface to the apex surface are in each case clearly delimited or defined as a flat trapezoid.

In an another practical embodiment, the apex is provided with holes that each have a diameter in the range of 1.8 mm to 5 mm, preferably 2 mm. A scooping effect is thereby achieved for the washing liquid. The element is preferably designed as a hollow body or bead in the drum shell, thus creating a water storage unit that can lift a part of the washing liquid located in the drum as it rotates. The so-called scooping effect driver element is thereby achieved The flanks or side surfaces that connect the base surface to the apex are preferably free of holes.

The drum is preferably designed for a washing machine or a washer dryer for carrying out a washing process. In this case, the shell is provided with holes for through-flow of fluid, which holes preferably have a diameter in the range of 1.8 mm to 5 mm, preferably 2 mm. The surface on the shell that surrounds the base surface of the element is free of holes in a range of 1 cm to 3 cm.

In an advantageous further development, the shell is provided with a curved structure, preferably made of individual polygons, preferably hexagons having a width across flats in the range of 2 cm to 5 cm, wherein the holes are arranged for the through-flow of fluid into the webs formed by the outlines of the hexagons.

The surface on the shell that surrounds the base surface of the element is free of curvatures in a range of 1 cm to 3 cm.

In an overall advantageous embodiment, at least two driver elements are arranged at a distance from one another on the shell, wherein element is arranged in the lower region at 0° and the other element is arranged at 180° of the circumferential angle on a path. A path refers to a line on the circumference of the shell that is at the same distance from the lateral boundary of the shell around the entire circumference, i.e., toward the front and toward the rear end face.

In an advantageous further development, the shell is equipped with at least one further path having at least two driver elements in each case. The further path lies at a distance from the first path at a distance corresponding to approximately ⅙ to ¼ of the distance between the two end walls. All paths are also located at a distance from the respectively adjacent end wall, as described above.

In another practical further development, the elements are arranged on the further path in such a way that the second path is rotated relative to the first path by an angle in the range of 10° to 45° so that the first element and the second element of the second path are arranged offset by this angle relative to the elements of the first path.

In an overall practical embodiment, the drum or at least the shell is made of a metal sheet, wherein the driver element in the form of a truncated pyramid is formed from the metal sheet. This integral formation is easy to accomplish and very stable, even at high centrifugal speeds, because the formation is completely surrounded by undeformed sheet metal. The stability of the shell or of the drum is improved overall.

In another embodiment, the shell is made of sheet metal, wherein the driver element(s) are separate parts that are fastened to the inner side of the shell, for example by bonding, screws or rivets.

For household washing machines that allow loads of 6 to 10 kg of dry laundry, it is practical if the drum has a diameter in the range of 45 to 60 cm, a drum volume of about 45 L to 65 L and a depth in the range of 20 cm to 60 cm. The driver element has a diameter in the range of 8 to 15 cm on the base surface, wherein the height of 0.5 to 3 cm and the apex surface has a diameter in the range of 1 cm to 8 cm.

For commercial washing machines, the drum size is correspondingly increased depending on the maximum load required. In this case, the driver element preferably has the above-mentioned dimensions.

The disclosure further relates to a washing machine comprising a suds container having a drum that is rotatably mounted therein about a horizontal or inclined axis and is driven via an electric motor, as described above, and a housing having a loading opening via which the interior of the drum is accessible, wherein the loading opening can be closed by means of the door, a water inlet that provides the introduction of the water from the supply network and a drain for draining used washing liquid or rinse water from the suds container, and a control device, which controls at least the water inlet, the activity of the drain and the drive motor in order to carry out a treatment program or washing program. In this case, the control device is connected to an operating and display apparatus by means of which the user can make inputs for program selection or further adjustments to the processes.

BRIEF DESCRIPTION OF THE DRAWINGS

An embodiment of the disclosure is shown purely schematically in the drawings and is described in more detail below. In the drawings.

DETAILED DESCRIPTION OF THE DRAWINGS

Figure 1:
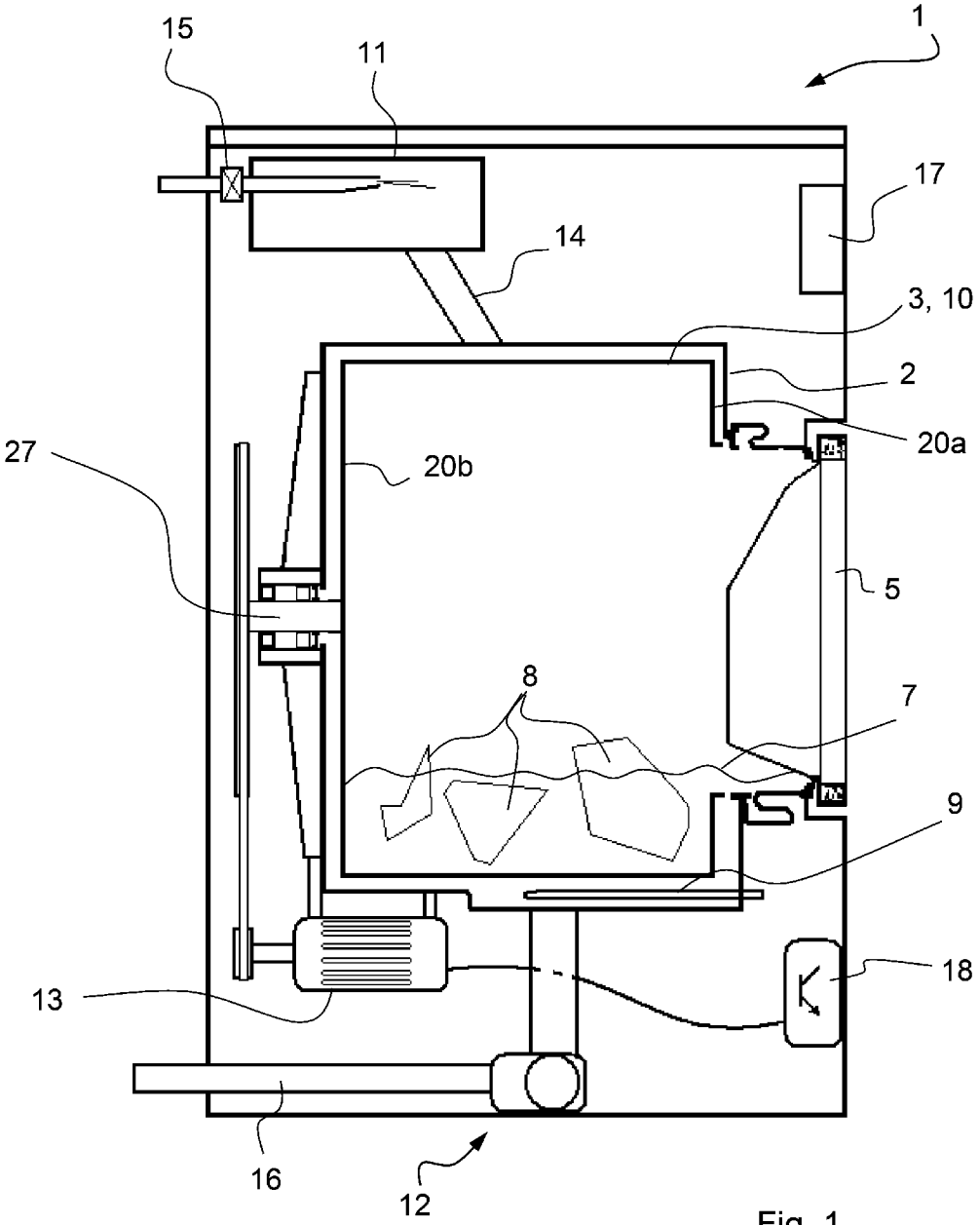
FIG. 1: shows a washing machine in a sketched sectional view.

FIG. 1 is a purely schematic representation of a washing machine 1 having a suds container 2. Positions and directions are given relative to the washing machine 1 in its upright position of use. A drum 3 that is rotatably mounted about a horizontal or inclined axis 27 and driven via an electric motor 13 is arranged inside the suds container 2 and moves the laundry items 8 located in the suds container 2 or in the drum 3. In the present embodiment, the drum 3 is made of stainless steel and is provided with a plurality of holes for flow therethrough. The housing 4 has a loading opening 9 via which the interior of the drum 3 is accessible through the bellows seal 6. The loading opening 9 can be closed by means of the door 5. The washing liquid 7 required to clean or treat the laundry 8 is located in the lower region of the suds container 2. A heating element 9 is arranged in the lower region of the suds container 2 for heating the liquid 7. An inlet valve 15 is indicated in the upper region of the machine 1, which inlet valve controls the introduction of water from the supply network. Water is introduced into the suds container 2 through the dispensing compartment 11 and connecting tube 14, wherein detergent that has been filled into the dispensing compartment 11 is washed into the suds container 2. Arranged below the suds container is a drain 12 through which the used washing liquid or the rinse water 7 is passed from the suds container 2 to the drain conduit 16, which generally discharges into a sewer. The control device 17 controls the water inlet 15, the activity of the drain 12, and the drive motor 13, which is energized by the power section or a frequency converter 18.

Figure 2:
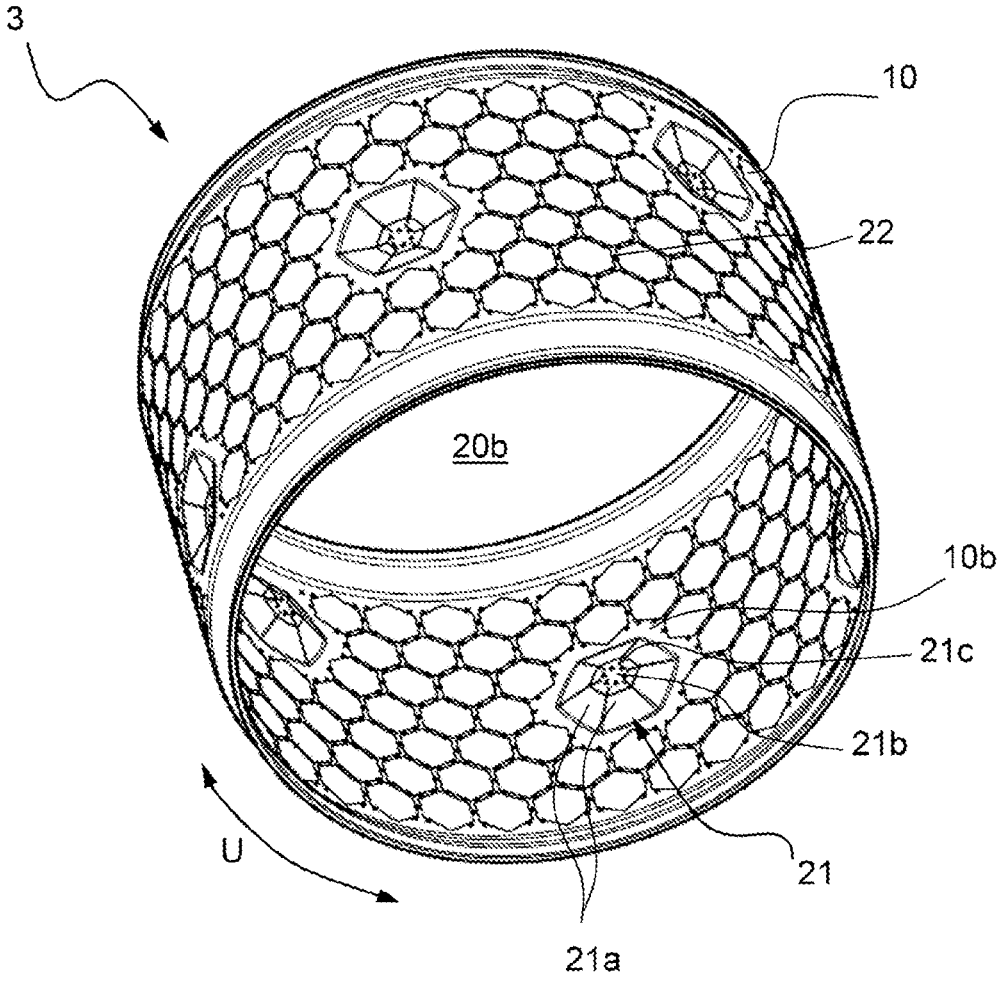
FIG. 2: shows the drum in a perspective view.

FIG. 2 shows the drum 3, which consists of a shell 10 and two opposite end walls 20*a*, 20*b*, wherein the front end wall 20*a* has been removed here to better illustrate the inner side of the shell 10. A plurality of driver elements 21 distributed over the circumference, three in this example, are attached to the inner side 10*a* of the shell 10. The driver elements 21 are as hexagonal pyramid with substantially equal sides, so that a flat trapezoid is formed in the sectional profile. The drum 3, in particular the shell 10, is perforated, wherein the holes 22 are evenly or unevenly distributed on the shell 10 and have a diameter of about 1.8 to 2.5 mm, preferably 2 mm. In this example, the drum 3 is rotated in the circumferential direction U. The laundry 8 (FIG. 1) located in the drum 3 is raised by means of the driver element 21. Once the driver element 21 is located further up, preferably above the center, the friction on the surface of the side flank 21*a* of the element 21 is no longer sufficient to hold the laundry item 8, so that the entrained laundry items 8 slip off the element 21. Due to the fact that the driver element 21 occupies only a small portion of the drum depth, preferably only a portion of ⅙ to ⅓, the laundry item 8 reached by the element is subjected to force in the circumferential direction U and additionally to an impulse lateral to the circumferential direction U, i.e., in the axial direction. In addition to the rolling movement, a tumbling movement of the laundry 8 is thereby caused, which intensifies the mechanical effect without stressing the laundry 8. Depending on the drive characteristics, the laundry items 8 are subjected only to force impulses, whereby they can enter a trajectory with lateral rotation or a curved trajectory. Overall, good mixing of the individual laundry items 8 is achieved because each laundry item 8 is subjected to force impulses that act differently and thereby cause different movements in the laundry items 8 in each case. The apex 21*c* of the curvature 21 directed toward the drum interior is designed as a plane or as a slightly convex curved plane. In this example, the apex surface 21*c* has the same basic shape as the curvature 21 on the base surface, in this case an equilateral hexagon. The surface 10*b* on the drum shell 10 that surrounds the driver element is free of through-flow holes. The surface 10*b* surrounds the base surface of the element 21 in an at least approximately annular manner, wherein said surface is preferably approximately 1 cm to 3 cm wide.

Figure 3:
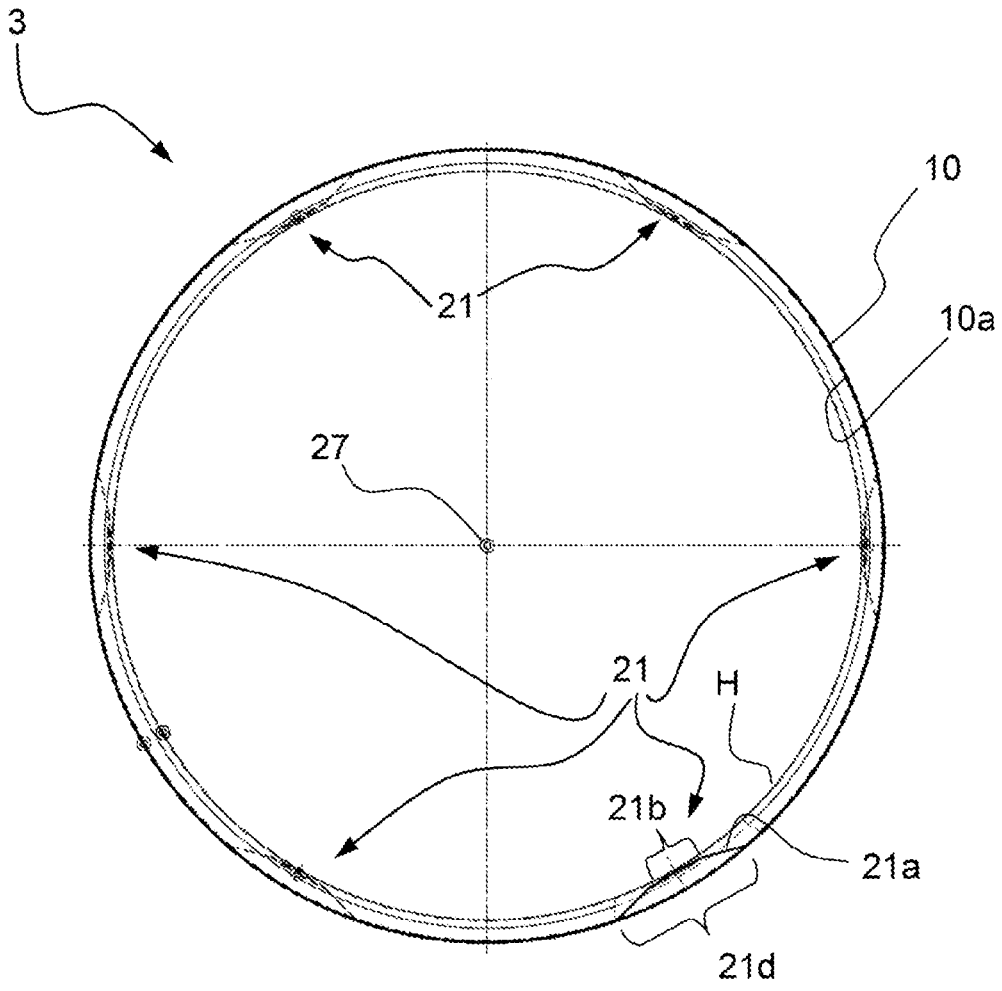
FIG. 3: shows the drum in a side view.

FIG. 3 shows the drum shell in a side view in which the height and the profile of the driver elements 21 are clearly visible. The driver element 21 has a base surface 21*d* having a diameter of approximately 1/20 to 1/16 of the shell circumference, wherein the height H, i.e., the bulge toward the axis, is approximately 0.5 cm to 3 cm, preferably 1 to 1.5 cm. The height H is indicated here as an auxiliary line. The diameter of the apex surface 21*b* is approximately 0.2 times to 0.5 times the diameter of the base surface 21*d*, preferably 0.3 times. Said information applies to all driver elements 21 arranged in or on the shell.

Figure 4:
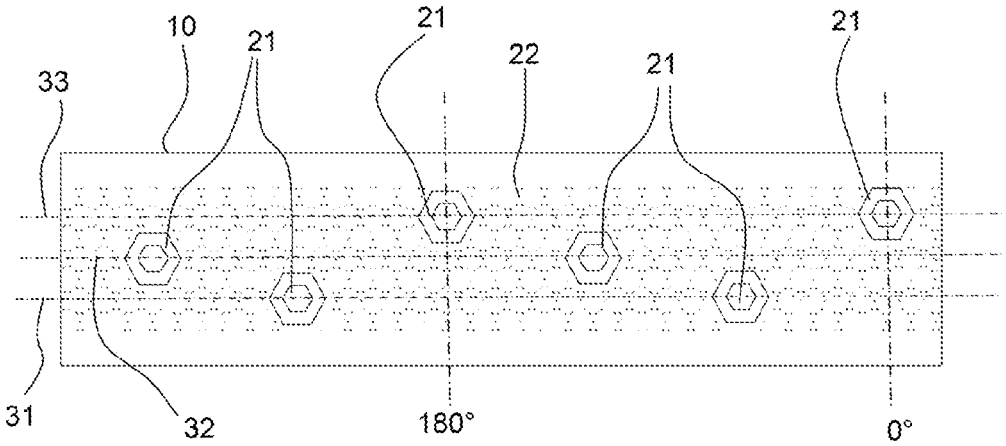
FIG. 4: shows the drum shell as a development.

FIG. 4 shows the drum shell 10 as a development with a view of the inner side, i.e., the side that comes into contact with the laundry 8 during operation. The through-flow holes 22 can be seen. In this preferred embodiment, the shell 10 is provided with a curved structure made of hexagons, wherein the holes 22 are arranged in the webs between the curvatures. The curvatures are directed toward the drum interior. The shell is also provided with driver elements 21, as described above. The shell 10 is provided with three paths 31, 32, 33 as reference lines, wherein a first path 31 runs close to the front edge, the second path 32 runs in the center, and the third path 33 runs close to the rear edge. Two driver elements 21, which are at a maximum distance from one another when the shell 10 is formed into the cylinder, are located on each path 31, 32, 33. The elements 21 of the first path 31 are arranged offset relative to the elements 21 on the adjacent center path 32. The second path 32 is preferably rotated with respect to the first path 31 by an angle in the range of 10° to 45° so that the first element 21 and the first element 21 of the second path 32 are arranged offset by this angle.

The elements 21 of the center path 32 are arranged so as to be offset relative to the elements 21 on the adjacent outer path 33 arranged close to the rear edge. Preferably, the third path 33 is rotated with respect to the center path 32 by an angle in the range of 10° to 45° so that the first element 21 of the outer path 33 and the first element of the center path 32 are arranged offset by this angle. This offset arises for all elements 21 arranged on the paths 31, 32, 33. Overall, all direction and position information relates to the proper position of the drum 3.

The invention claimed is:

1. A drum for a washing machine comprising a suds container, in which the drum can be rotatably mounted about a horizontal or inclined axis, comprising a cylindrical shell that is delimited by means of two opposite end walls, and at least one driver element that is attached to the inner surface of the shell, wherein the driver element is configured as a curved body having a curvature directed toward the drum interior and is arranged at a distance from the end walls;

wherein the shell is provided with a curved structure formed from individual hexagons; and wherein the shell is provided with holes for through-flow of fluid, the holes being arranged in webs formed from the outlines of the hexagons.

2. The drum according to claim 1, wherein the driver element is designed as a truncated pyramid having a circular or polygonal base surface, wherein the diameter of the base surface has a value that corresponds to approximately 1/6 to 1/3 of the distance between the two end walls on the shell.

3. The drum according to claim 2, wherein the base surface of the truncated pyramid is configured as a circle, an at least virtually equilateral triangle, a square, a pentagon, a heptagon, an octagon, or a hexagon.

4. The drum according to claim 1, wherein the apex of the truncated pyramid is flat or curved and the outline corresponds to the shape of the outline of the base surface.

5. The drum according to claim 1, wherein the apex is provided with holes that have a diameter in the range of 1.8 mm to 5 mm.

6. The drum according to claim 1, wherein the flanks that connect the base surface to the apex are free of holes.

7. The drum according to claim 1, wherein the holes for through-flow of fluid have a diameter in the range of 1.8 mm to 5 mm, and wherein the surface on the shell surrounding the base surface of the element is free of holes in a range of 1 cm to 3 cm.

8. The drum according to claim 7, wherein the individual hexagons have a width across flats in the range of 2 cm to 5 cm, and wherein the surface on the shell surrounding the base surface of the element is free of curvatures in a range of 1 cm to 3 cm.

9. The drum according to claim 1, wherein at least two driver elements are arranged at a distance from one another on the shell, wherein element is arranged in the lower region at 0° and the other element is arranged at 180° of the circumferential angle on a path.

10. The drum according to claim 9, wherein the at least two further elements are arranged on a further path on the shell, wherein the further path lies at a distance from the first path that corresponds to approximately 1/4 to 1/2 of the distance between the two end walls.

11. The drum according to claim 10, wherein the first path and further path are arranged at a distance from the respectively adjacent end wall that corresponds approximately to 1/6 to 1/4 of the distance between the two end walls.

12. The drum according to claim 10, wherein the elements are arranged on the further path in such a way that the second path is rotated at an angle in the range of 10° to 45° with respect to the first path, so that the first element and the first element of the second path are arranged offset by this angle with respect to the elements of the first path.

13. The drum according to claim 1, wherein the drum or at least the shell is made of a metal sheet, wherein the driver element in the form of a truncated pyramid is formed from the metal sheet.

14. The drum according to claim 1, wherein the drum or at least the shell is made of a metal sheet, wherein the driver element in the form of a truncated pyramid is attached as a separate part on the inner side of the shell.

15. The drum according to claim 1, wherein the drum has a diameter in the range of 45 to 60 cm, a depth in the range of 20 cm to 60 cm, wherein the driver element at the base surface has a diameter in the range of 8 to 15 cm, a height of 0.5 to 3 cm, and the apex surface has a diameter in the range of 1 cm to 8 cm.

16. A washing machine comprising a suds container having a drum that is rotatably mounted therein via a horizontal or inclined axis and is driven via an electric motor according to claim 1, and a housing having a loading opening via which the interior of the drum is accessible, wherein the loading opening can be closed by means of the door, a water inlet that provides the introduction of the water from the supply network and a drain for draining used washing liquid or rinse water from the suds container, and a control device, which controls at least the water inlet, the activity of the drain and of the drive motor in order to carry out a treatment program.

* * * * *